US006550086B2

(12) United States Patent
Boyd

(10) Patent No.: US 6,550,086 B2
(45) Date of Patent: Apr. 22, 2003

(54) AIRBED VALVE SYSTEM

(75) Inventor: Dennis Boyd, Maryland Heights, MO (US)

(73) Assignee: Boyd Flotation, Inc., Maryland Heights, MO (US)

( * ) Notice: Subject to any disclaimer, the term of this patent is extended or adjusted under 35 U.S.C. 154(b) by 0 days.

(21) Appl. No.: 09/909,794

(22) Filed: Jul. 20, 2001

(65) Prior Publication Data

US 2003/0014821 A1 Jan. 23, 2003

(51) Int. Cl.[7] ..... A47C 27/08; F16L 29/02
(52) U.S. Cl. ..... 5/706; 5/713; 137/223
(58) Field of Search ..... 5/706, 710, 713, 5/708; 137/223

(56) References Cited

U.S. PATENT DOCUMENTS 2,309,430 A * 1/1943 Albert ..... 137/223
4,579,141 A * 4/1986 Arff ..... 137/223
4,766,628 A * 8/1988 Walker ..... 137/232
5,111,838 A * 5/1992 Langston ..... 137/223
5,367,726 A * 11/1994 Chaffee ..... 137/223
5,941,272 A * 8/1999 Feldman ..... 137/223
6,234,450 B1 * 5/2001 Jeory ..... 137/223

* cited by examiner

*Primary Examiner*—Michael F. Trettel
(74) *Attorney, Agent, or Firm*—Thompson Coburn LLP; Gregory E. Upchurch

(57) ABSTRACT

An airbed mattress includes a valve for controlling inflation of the mattress. The valve is normally biased to a closed position to prevent changes in the mattress' level of inflation. The valve may be opened by introduction of an air pump. The valve and air pump are designed to operate cooperatively by employment of an adaptor to facilitate the introduction of the air pump. The valve has an air passageway which contains an internal airflow control assembly. The control assembly operates to open the valve to passage of air upon introduction of the air pump and adaptor as well as effecting the closing of the valve when the air pump and adaptor are withdrawn. The valve also may have an extension adapted for a releasable connection with an air pump and adaptor for holding the valve open.

22 Claims, 7 Drawing Sheets

AIRBED VALVE SYSTEM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not Applicable.

BACKGROUND OF THE INVENTION

Airbeds have increased in popularity due in part to flexibility of use, ease of set-up and reduction of storage space—all without sacrifices in comfort. An airbed's level of inflation may be adjusted by adding or removing air through a port, optionally in combination with a source of air such as a pump. A valve typically controls airflow through the port and usually operates in concert with an air pump.

An airbed valve preferably has an open mode to enable air passage into and out of the airbed, and a closed mode to maintain the airbed's level of inflation when in use. Preferably the valve can switch readily between modes with minimal actions beyond the introduction of the air pump. The airbed and valve preferably are reliable, compatible with bedding materials, strong enough for frequent long term use, and relatively inexpensive to manufacture.

SUMMARY OF THE INVENTION

An object of the present invention is to provide an apparatus which provides selective control of an airbed's level of inflation by movement of air into or out of the airbed.

Another object of the present invention is to provide an airbed inflation control apparatus which is easy to use in a variety of applications.

A further object of the present invention is to provide an airbed inflation control apparatus of rugged and simple construction which is relatively inexpensive yet operates reliably.

Other objects and features will be in part apparent and in part pointed out hereinafter.

In a first aspect of the present invention an inflatable and deflatable airbed includes an airtight membrane having an interior and an exterior, the membrane being inflatable by adding air to the interior of the membrane. A valve controls passage of air into and out of the membrane, the valve having a longitudinal axis and including a housing. The housing defines an air passageway into the interior of the membrane, the air passageway having a greater radius inside of the membrane than outside the membrane. The air passageway contains an airflow control assembly that includes a longitudinally movable plug sized to fit in and move in the air passageway. The housing has an interior end that is spanned by a housing base, the housing base having at least one aperture open to air flow between the air passageway and the interior. The airflow control assembly biases the plug toward the exterior of the membrane. When the plug is forced against the housing in response to the bias, it forms an airtight closure to prevent airflow through the air passageway. When the plug is moved in a direction opposite to the bias, it opens the valve to air flow through the air passageway.

A second aspect of the present invention includes the airflow control valve used in connection with such an airbed.

A method of connecting an air pump with the inventive airflow control valve to inflate the airbed is also disclosed.

BRIEF DESCRIPTION OF THE DRAWINGS

Similar reference characters indicate similar parts throughout the several views of the drawings.

DETAILED DESCRIPTION OF THE PREFERRED EMBODIMENT

Figure 1:
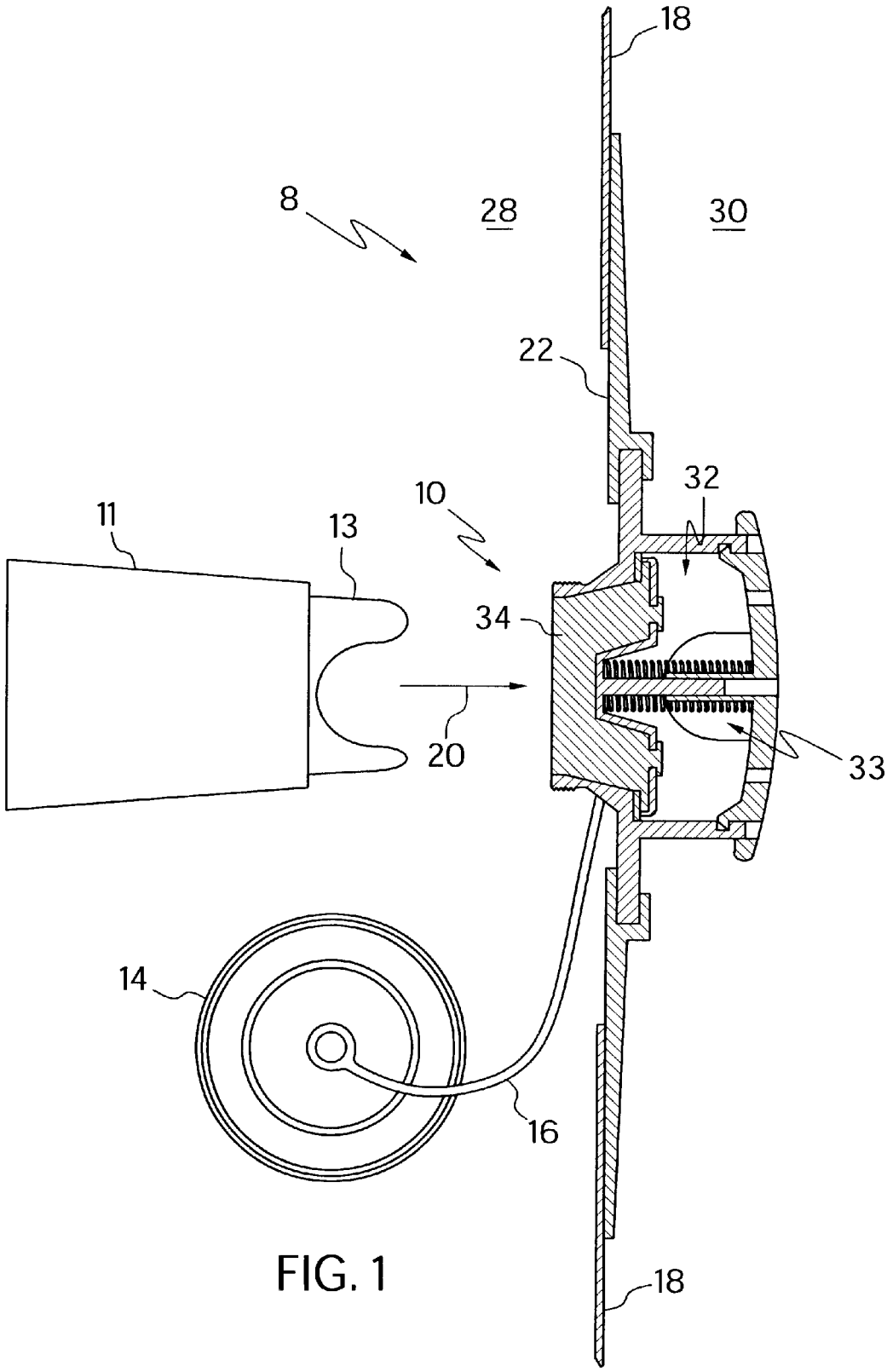
FIG. 1 is a cross-sectional view of a valve apparatus of the present invention along with representations of a cap and an adaptor device for interconnection with an air pump.

Referring to FIG. 1, an airbed 8 (only a portion of which is shown), with a valve apparatus 10 according to a first embodiment of the present invention is depicted with an adaptor 11. The adaptor 11 opens the valve apparatus 10 for introduction of an air pump (not depicted). The adaptor 11 has an end projection 13. The end projection 13 is depicted in one of a variety of configurations available, subject to the operational requirements that the adaptor end projection 13 fit in flush contact about a perimeter area of the valve and is configured such that the end projection 13 is able to open the valve. End projection 13 is further configured so that when the end projection 13 opens the valve a free flow of air from the pump to the valve as well as from the valve to the pump is not impeded. An end cap 14 for closure of the valve assembly when the airbed's inflation level is not being altered is attached with a tether 16. An arrow 20 lies along the longitudinal axis of the valve apparatus 10 and indicates the direction of airflow when the airbed 8 is being inflated. The valve apparatus 10 is generally rotationally symmetrical about the longitudinal axis which arrow 20 lies along. An internal inflatable region 30 of the airbed 8 is contained within a membrane 18, a portion of said membrane 18 about the valve's circumference being airtight sealed to a radial extension 22 girdling the perimeter of the valve apparatus 10. Said membrane and contiguous valve parts define a boundary surface dividing an external region 28 of the airbed 8 from an internal region 30. Within an interior 32 of the valve apparatus 10 is contained an airflow control assembly 33. The airflow control assembly 33 includes a solid plug 34.

Figure 2:
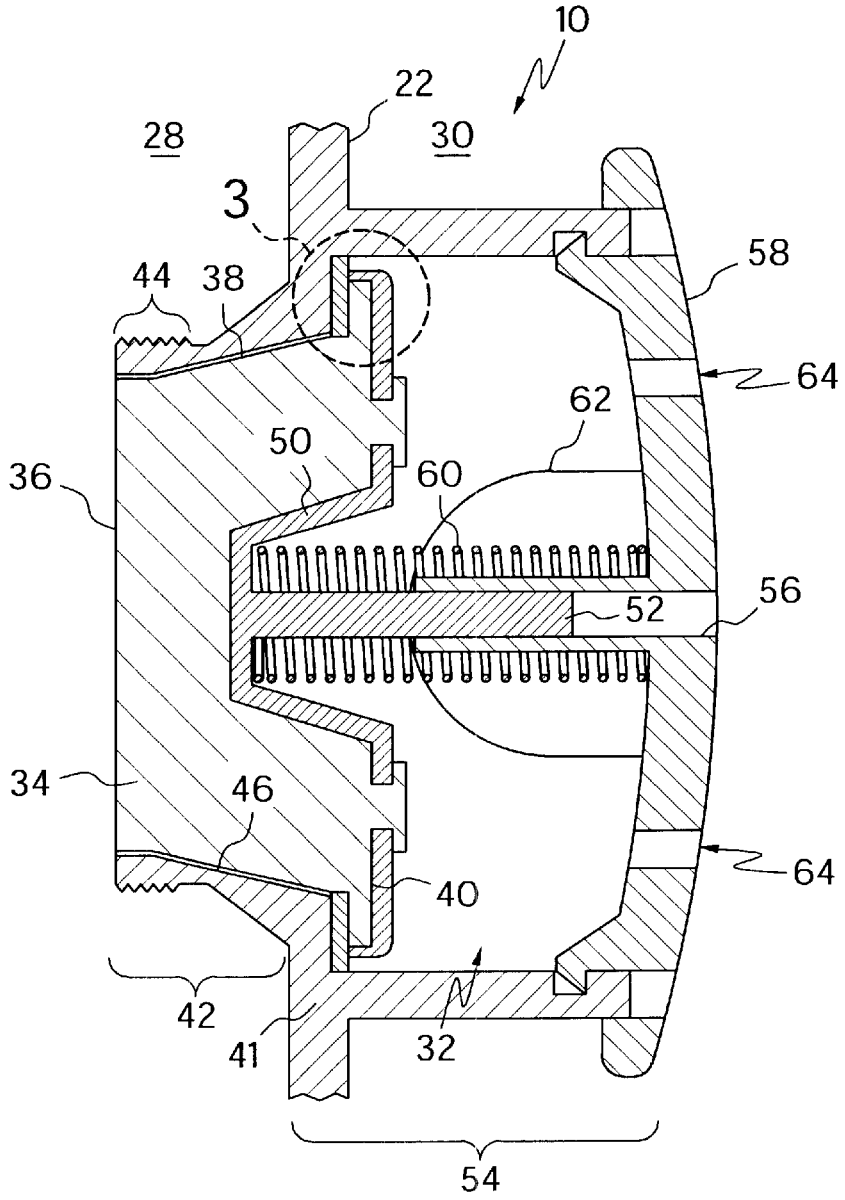
FIGS. 2 and 2A are expanded cross-sectional views of alternatives of the airflow control assembly of the valve apparatus of the present invention wherein the valve apparatus is depicted in a closed configuration.

Referring now to FIG. 2, the valve apparatus 10 is depicted when maintaining a constant airbed 8 degree of inflation, such as when the airbed 8 is in use, wherein the plug 34 is at its maximum externally directed location. The plug 34 has an external end surface 36, a plug side surface 38, and an internal end 40. End projection 13 pressing on the external end surface 36 in the direction 20 opens the valve apparatus 10 for introducing the adaptor 11. The valve apparatus 10 has a housing 41. The housing 41 has an external section 42. Around the exterior of the terminal end of the housing external section 42 is a threaded portion 44 for receiving the screw-on cap 14. The plug side surface 38 fits in flush contact with an interior surface 46 of the housing external section 42. A plug seat 50 is affixed to the internal end 40 of the plug 34. A post 52 extends internally from the plug seat 50. The plug seat 50 substantially spans nearly all of the width of a valve apparatus housing internal section 54. The post 52 is slidably received within a post guide 56 which is part of a fixed housing base 58. A spring 60 biases the plug seat 50 in the external direction away from the fixed housing base 58 to effect a normal plug and plug seat position at the limit of their externally directed movement. A scallop member 62 (depicted schematically) disposed within the apparatus interior 32 is fixedly connected to the housing base 58 and limits the internally directed travel of the plug and plug seat. The plug 34, plug seat 50, post 52, post guide 56, housing base 58, spring 60 and scallop member 62 are parts of the airflow control assembly 33. Apertures 64 (depicted schematically) are passageways for airflow between the apparatus interior 32 and the internal region 30.

Figure 2A:
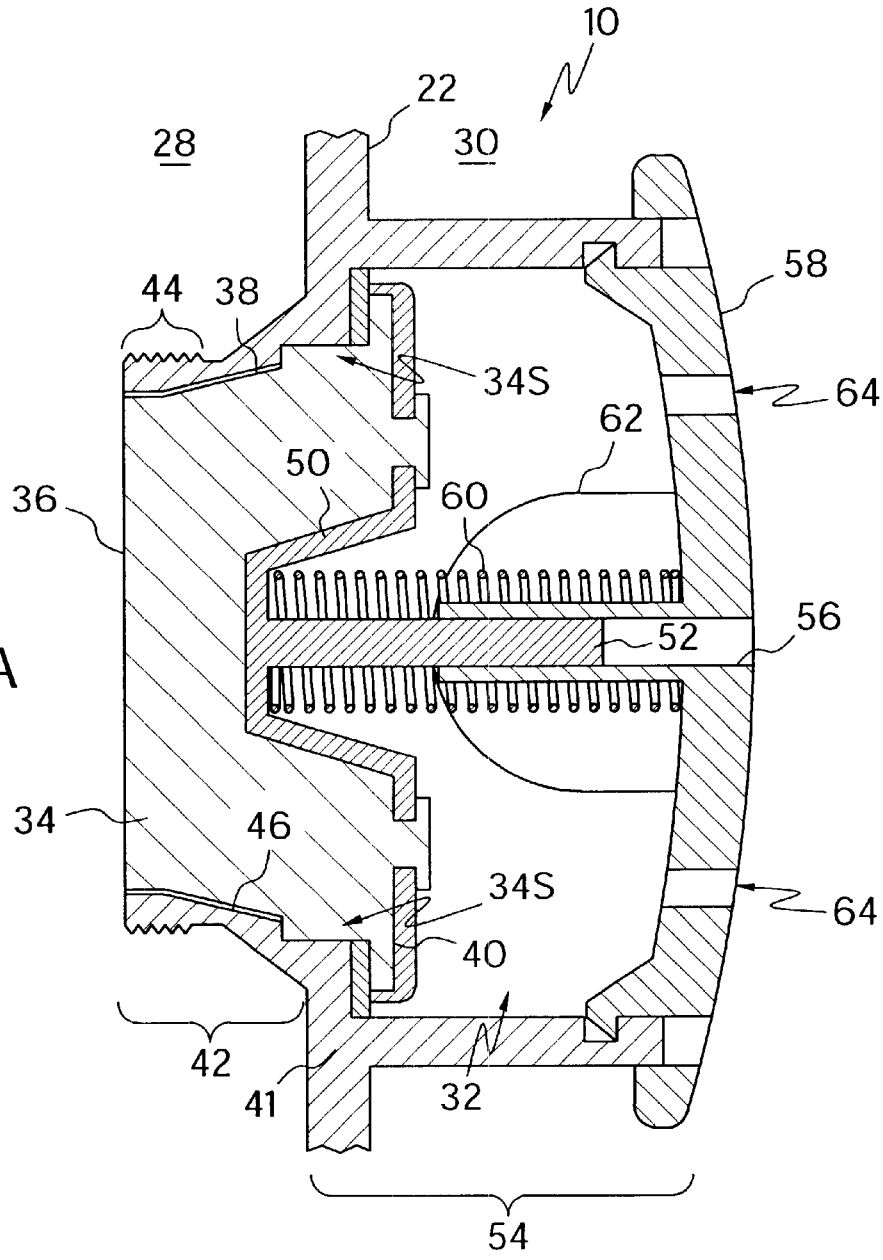

As can be seen in FIG. 2A, the plug 34 may be of various shapes. Although the plug is smoothly tapered in FIG. 2, in FIG. 2A it has steps shown at 34S that extend circumferentially around the plug. The housing is varied in shape in this embodiment to accommodate the stepped plug. Although a single step is shown, a number of steps may be formed in plug 34. Moreover, although the housing is shown as shaped to accommodate the stepped plug, it should be realized that steps may be formed with radii such that the tapered housing of FIG. 2 may still be used. In that case, the main sealing action would occur between the point of the step and the housing, rather than along the sides of the step. Of course, the precise place where such sealing occurs is of minor importance so long as sealing occurs.

Figure 3:
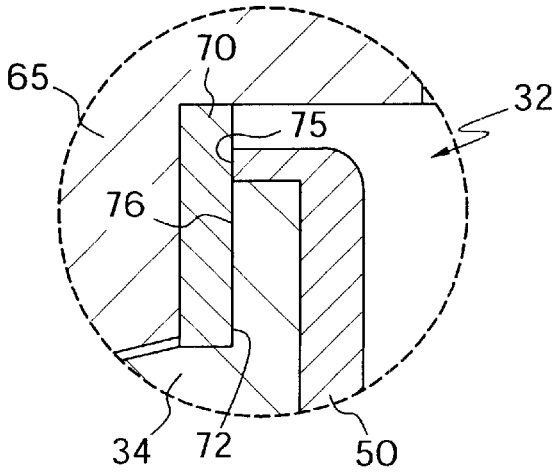
FIG. 3 is a further expanded view of FIG. 2 depicting details of an interior shelf portion of the valve apparatus of the present invention wherein the valve apparatus is depicted in a closed configuration.

Referring next to FIG. 3, an enlarged view in detail of the area indicated with the dashed circle in FIG. 2 is depicted showing a juncture of the plug and plug seat with an interior shelf 65 of the housing 41. A resilient pad 70, which may be composed of a variety of compressible materials but is preferably foam rubber, is attached to the interior shelf 65. When the plug 34 is at its limit of externally directed travel, an internally facing surface 72 of pad 70 is pressed upon by an externally facing surface 75 of the outermost portion of plug seat 50 and by an externally facing surface 76 of the plug 34. Contact of the surface 72 with the surfaces 75 and 76 obstructs airflow through the valve interior 32. The obstruction of airflow through the valve interior 32 prevents airflow into or out from the internal region 30, thereby blocking changes in the airbed 8 level of inflation.

Figure 4:
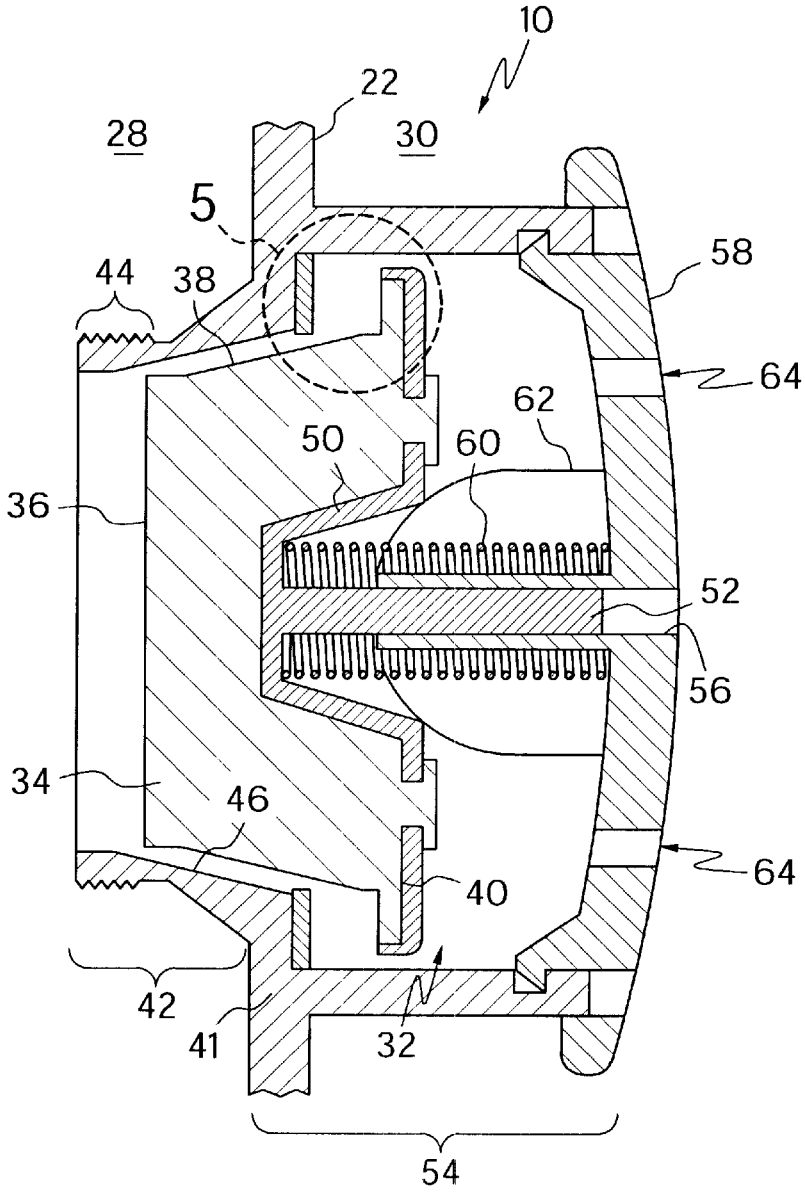
FIG. 4 is an expanded cross-sectional view of the airflow control assembly of the valve apparatus of the present invention wherein the valve apparatus is depicted in an open configuration.
Figure 5:
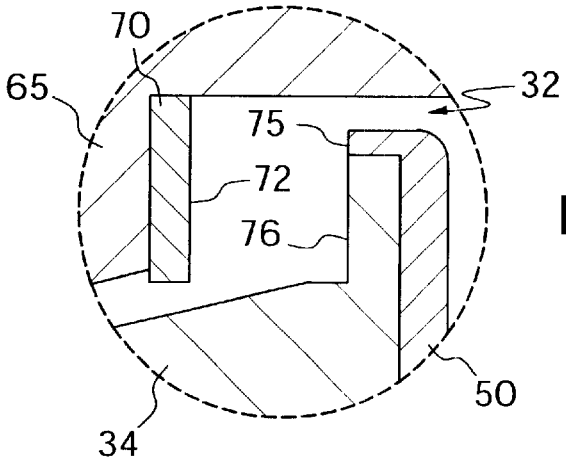
FIG. 5 is a further expanded view of FIG. 4 depicting details of an interior shelf portion of the valve apparatus of the present invention wherein the valve apparatus is depicted in an open configuration.

FIGS. 4 and 5 depict the same elements in the same views as in FIGS. 2 & 3, respectively, differing only by the plug 34 and plug seat 50 being at their internally directed limit of movement. The internally directed motion of valve apparatus 10 is caused by introduction of adaptor 11 and projection 13 (not depicted). At its limit of internally directed travel the plug seat 50 contacts the scallop 62. Air passageways between the surface 38 and the surface 46, and between the surfaces 75 and 76 and the surface 72 are opened by the internally directed movement of the plug seat 50. These passageways enable inflation or deflation of the membrane 18 by airflow through the valve interior 32.

While a wide variety of materials and compositions of matter can serve well to construct the present invention, the plug 34 is preferably composed of rubber and the plug seat 50 of plastic.

Figure 6:
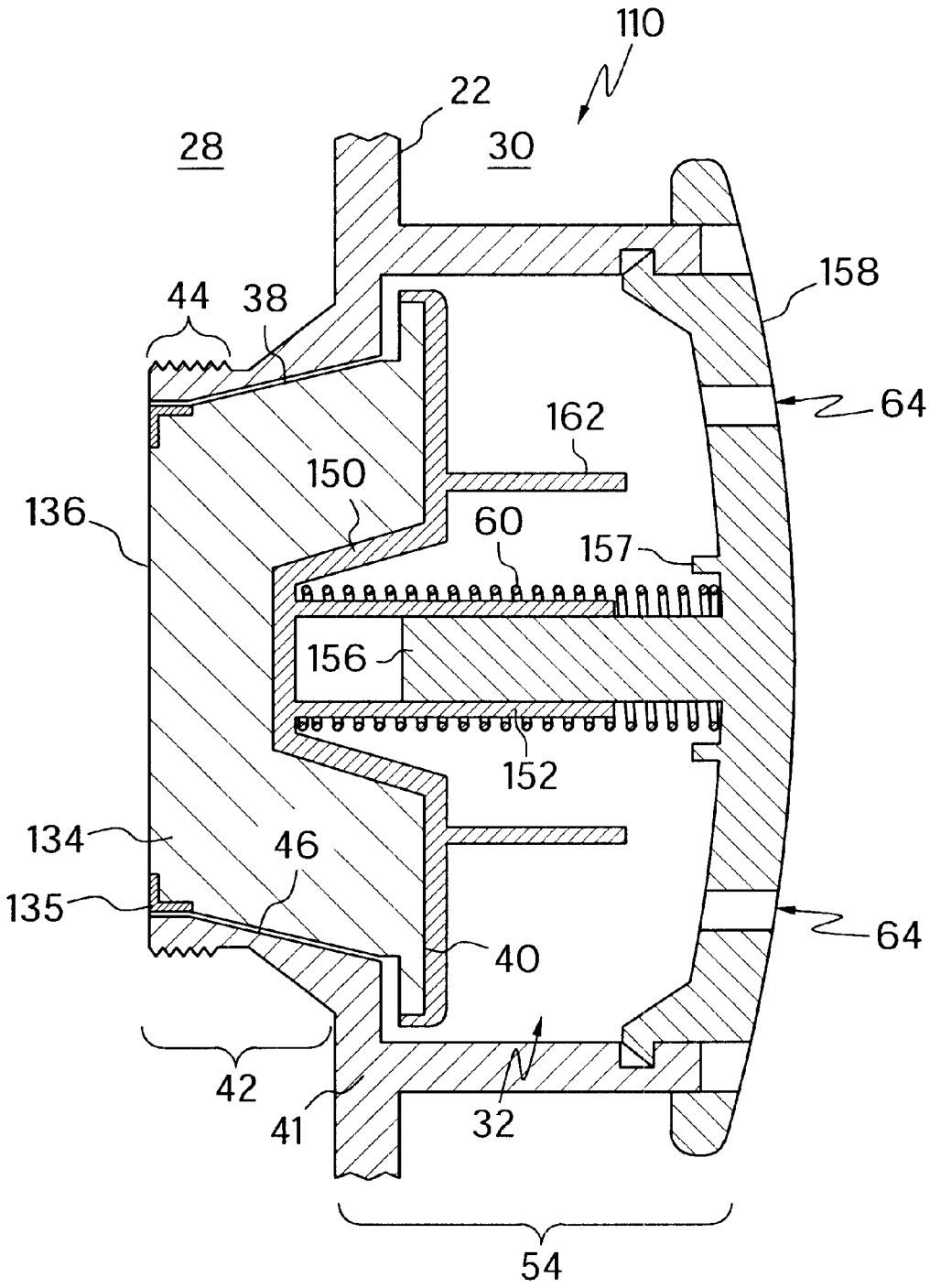
FIG. 6 is an expanded cross-sectional view of a valve apparatus 110 according to a second embodiment of the present invention.

Referring now to FIG. 6, which is a cross-section view of a valve apparatus 110 that is modified in three ways from the valve apparatus 10 of the first embodiment. A first modification is the absence of the resilient pad 70, which is attached to the interior shelf 65 in the first embodiment. The space occupied by pad 70 in the first embodiment is an unoccupied part of the valve interior 132 in the second embodiment. When a plug 134 is at the limit of its externally directed movement, plug side surface 38 fits in flush contact with interior surface 46 to obstruct airflow through the valve apparatus 110. When the plug 134 is moved in the internal direction 20, air passes between plug side surface 38 and housing interior surface 46, thereby allowing airflow through the valve apparatus 110.

A second modification is to an external end surface 136 of plug 134. In the second embodiment, a corner ring 135 circles the outer border of external end surface 136. Corner ring 135 is preferably a hard plastic, but may be constructed of any material with the suitable properties. These properties are sufficient durability to withstand repeated pressings by the end projection 13 without significant structural degradation; and a surface which produces relatively low friction when contacting the interior surface 46. End projection 13 is formed from a cylindrical shell with a relatively narrow radial thickness. Corner ring 135 extends from the outer edge of the external end surface 136 towards the axial center of plug 134 sufficiently far to cover the entire contact area of end projection 13 with plug 134. The depth of corner ring 135 along the side 38 is sufficiently far to ensure that housing interior surface 46 only contacts corner ring 135 when the plug 134 is moving. In operation, corner ring 135 provides at least two benefits. First, the durability of corner ring 135 prevents damage to the plug 34 from repeated pressings by adaptor 13. Second, the lesser friction between interior surface 46 and the material of corner ring 135, versus the material of plug 134, allows plug 134 to more readily travel to its external limit of movement, for a faster and more complete closing of the valve. The desired degree of inflation of airbed 8 is thus easier to keep, once reached, since the quicker, complete closing of the valve reduces the escape of air.

A third modification is to the parts within the valve interior 132 which direct and control the motion of the plug 134. In the second embodiment, the post 52 of the first embodiment is now a post guide 152 that extends in an internal direction from a plug seat 150. The post guide 56 of the first embodiment is now a post 156 that extends in an external direction from a housing base 158 in the second embodiment. Post 156 and post guide 152 are also of greater width than post 52 and post guide 56 are in the first embodiment. This greater width, preferably in combination with a close fitting of post guide 152 to post 156, reduces undesired plug 134 movement in a direction transverse to direction 20 when the valve apparatus 110 is open. A spring retaining guide 157 extending from housing base 158 encircles the perimeter of spring 60. Spring retaining guide 157 maintains the desired positioning of the spring 60 during movement of plug 134. The scallop 62 of the first embodiment is absent in the second embodiment. A plurality of bars 162 extend in an internal direction from plug seat 150 to a fraction of the depth of the valve interior 132. Bars 162 contacting housing base 158 arrest the internally directed motion of plug 134. While bars 162 are depicted as being longer than the height of spring retaining guide 157, in an alternative embodiment spring retaining guide 157 may be equal or greater in height than the length of bars 162, so that the internally directed movement of the plug 134 is arrested by contact of the plug seat 150 with the spring retaining guide 157.

Figure 7:
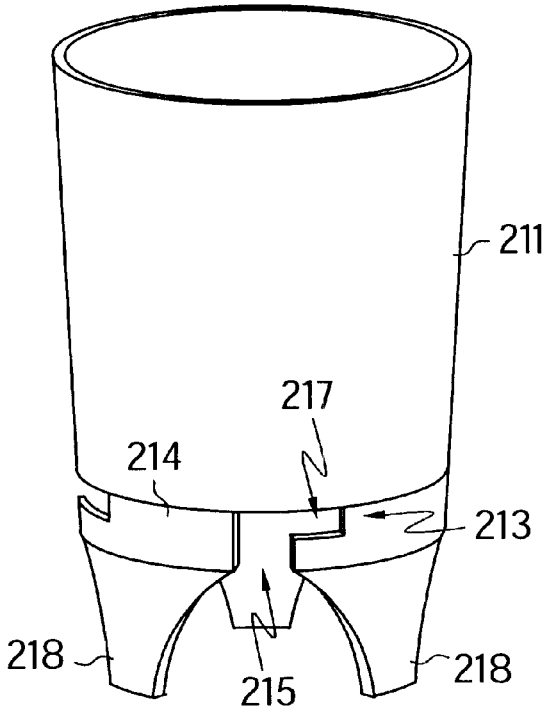
FIG. 7 is a perspective view of an adaptor 211 according to a third embodiment of the present invention.

Referring now to FIG. 7, an alternative adaptor 211 to be optionally used instead of adaptor 11 when introducing an air pump 8 into valve 10 (or valve 110). The adaptor 211 is specifically configured to work in cooperation with an alternative valve housing 241 depicted in FIG. 8, described subsequently. Adaptor 211 differs from adaptor 11 by an alternative end projection 213. A collar 214 and a plurality of legs 218 comprise end projection 213. Formed within collar 214 are a trio of vertical inset slots 215 connecting to a trio of horizontal slots 217. Each of slots 215 originate from a site in collar 214 midway between legs 218.

Figure 8:
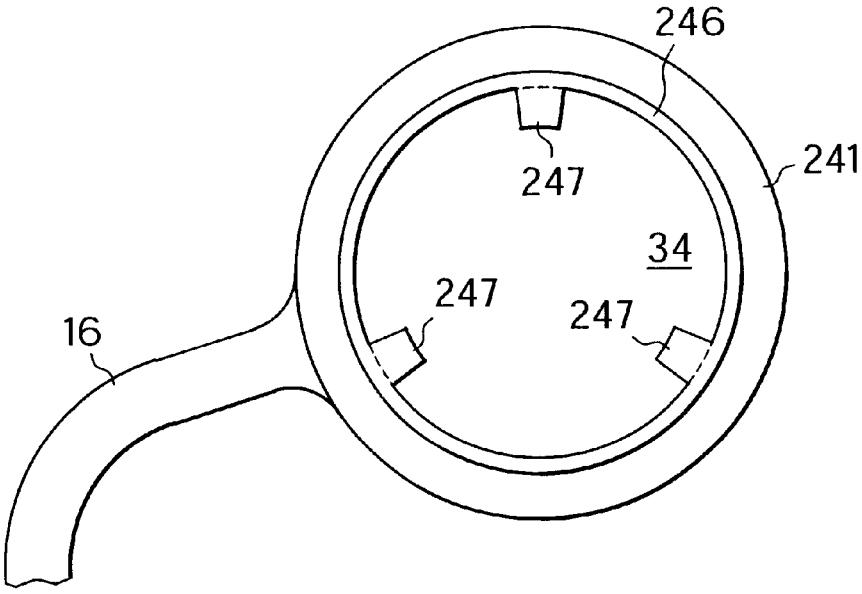
FIG. 8 is a view, in the direction 20 of FIG. 1, of an external section of an alternative valve housing 241 according to a third embodiment of the present invention.

Alternative valve housing extension 241 is configured to operate cooperatively with adaptor 211. From the perspective along the direction 20, an alternative housing interior surface extension 246 is seen in FIG. 8. Housing extension 241 extends externally above the external movement limit of plug 34, providing space external of plug 34 but still inside the confines of housing extension 241. Within this space, a trio of pegs 247 extend from the interior surface extension 246. Pegs 247 are spaced to simultaneously align with slots 215, and are sized to fit in slots 215 when adaptor 211 moves in the direction 20. Adaptor 211 moving in direction 20 opens the valve apparatus 10. Once at the limit of slots 215, the adaptor 211 is rotated clockwise, if viewed along direction 20. The rotation fits pegs 247 into slots 217. Once in slots 217, pegs 247 cannot move opposite to the direction 20 until the adaptor 211 is rotated counterclockwise to bring pegs 247 back to slots 215. The slots 215 and pegs 247 are thus able to selectively keep the adaptor in place when holding the valve apparatus open without requiring the user to continuously exert force to overcome the bias holding the valve closed. The cooperative action of adaptor 211 and housing extension 241 provides an easily securable and releasable connection between the valve apparatus 10 (or 110) and an air pump (not depicted). Since the pump takes at least some number of seconds to alter the airbed 8 degree of inflation, the securable connection provided by adaptor 211 and housing extension 241 allows the user to engage in other activities during this time. Alternatively, the slots 215 and 217 could be formed in the housing extension 241, and the pegs 247 could extend from the adaptor 213 to provide the same benefit. Still another alternative would be to have either the slots or pegs formed into a part of the air pump itself, with the corresponding pegs or slots formed in the housing extension 241, if that air pump is configured to fit directly into the valve apparatus without need of an adaptor 213. The configuration of slots and pegs described in the third embodiment of the present invention are intended to be merely illustrative and not limiting. It is projected that a multitude of differing cooperative elements can provide functional benefits similar to the pegs and slots, as is well known to those of skill in the art, without departing from the scope of the present invention.

Figure 9:
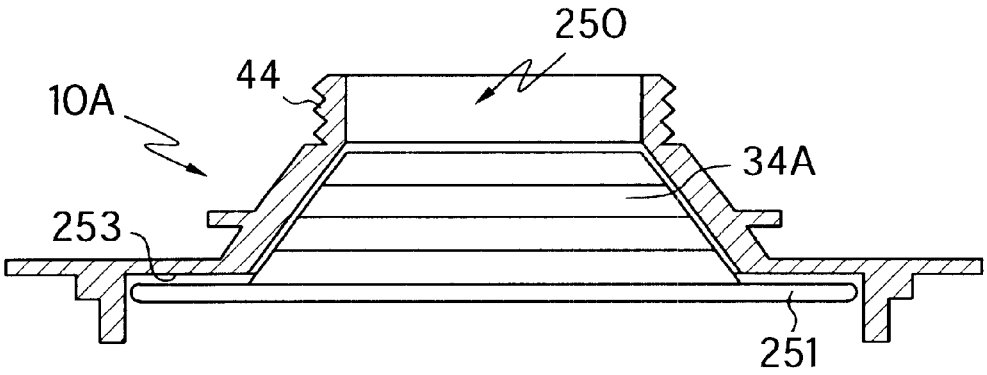
FIG. 9 is a view of an alternative structure for the valve plug.

Turning to FIG. 9, an alternative valve 10A is shown in simplified form (with the biasing spring and structure removed for clarity). Valve 10A includes a plug 34A that mates with the conical section of the valve body but stops short of the exterior end of the valve body. In this embodiment, the plug does not extend into the part of the passageway (labeled 250) surrounded by the threads 44. The interior portion of plug 34A has a thick rubber flange (for example, about 1/16" in thickness) that extends around the circumference of the plug body (for example, extending ½" out from the plug body). This integral flange 251 mates against a suitable sealing surface 253 to provide additional sealing. Of course, other minor variations in the shape and size of the plug and the housing could be used as well.

In the disclosure of the present invention the bed is described as being inflated by air but it should be understood that "air" as used herein is a generic term for any desirable inflation gas. In view of the above, it will be seen that the various objects and features of the invention are achieved and other advantageous results obtained. The examples contained herein are merely illustrative and are not intended in a limiting sense.

What is claimed is:

1. An inflatable and deflatable airbed comprising:

an airtight membrane having an interior and an exterior, the membrane being inflatable by adding air to the interior of the membrane;

a value integral with the membrane and controlling passage of air into and out of said membrane, said valve having a longitudinal axis and including a housing, said housing defining an air passageway into the interior of the membrane, said air passageway having a greater radius interior of the membrane than exterior of the membrane, said air passageway containing an airflow control assembly, said airflow control assembly including a longitudinally movable plug sized to fit in and move in said air passageway, said housing having an interior end that is spanned by a housing base, said housing base having at least one aperture open to air flow between the air passageway and the interior;

said airflow control assembly biasing said plug toward the exterior of the membrane;

said plug when the plug is forced against the housing in response to said bias, forming an airtight closure to prevent airflow through said air passageway; and said plug when moved in a direction opposite to said bias, opening said valve to air flow through said air passageway and into the interior of said membrane.

2. An airbed according to claim 1 wherein said airflow control assembly further includes a movable post extending along the longitudinal axis from said plug and a post guide extending along the longitudinal axis from said housing base, said post and post guide limiting transverse movement of said plug.

3. An airbed according to claim 1 further including a radial extension girdling the perimeter of said valve, wherein an inner border of said radial extension is joined by an airtight seal to said valve and an outer border of said radial extension is joined by an airtight seal to said membrane.

4. An airbed according to claim 1, wherein said housing additionally has an interior shelf adjacent to the air passageway; and said plug having a radially extending segment of sufficient radius for engaging said interior shelf at the limit of externally directed movement of said plug to prevent airflow through the valve.

5. The airbed as set forth in claim 4 wherein the radially extending segment is integrally formed on said plug.

6. The airbed as set forth in claim 1 wherein the plug is substantially solid.

7. The airbed as set forth in claim 1 wherein an interior surface of said housing forms a conical section which narrows in the direction from the interior to the exterior of the membrane, a side surface of said plug forming a mating conical section to cooperatively fit in flush contact with said housing conical section.

8. The airbed as set forth in claim 1 further including a spring between said housing base and said plug for biasing the plug.

9. The airbed as set forth in claim 8 wherein said airflow control assembly further includes a post extending along the longitudinal axis from said plug and a post guide extending along the longitudinal axis from said housing base, said post and post guide limiting transverse movement of said plug, and said spring coils around said post and post guide.

10. An inflatable and deflatable airbed comprising: an airtight membrane having an interior and an exterior, the membrane being inflatable by adding air to the interior of the membrane;

a valve integral with the membrane and controlling passage of air into and out of said membrane, said valve having a longitudinal axis and including a housing, said housing defining an air passageway into the interior of the membrane, said air passageway having a greater radius interior of the membrane than exterior of the membrane, said air passageway containing an airflow control assembly, said airflow control assembly including a longitudinally movable plug sized to fit in and move in said air passageway, said housing having an interior end that is spanned by a housing base, said housing base having at least one aperture open to air flow between the air passageway and the interior;

said airflow control assembly biasing said plug toward the exterior of the membrane;

said plug when the plug is forced against the housing in response to said bias, forming an airtight closure to prevent airflow through said air passageway; and said plug when moved in a direction opposite to said bias, opening said valve to air flow through said air passageway, and into the interior of said membrane, and wherein said housing additionally has an interior shelf adjacent to the air passageway; and said plug having a radially extending segment of sufficient radius for engaging said interior shelf at the limit of externally directed movement of said plug to prevent airflow through the valve, and further wherein said valve housing includes a rib extending interiorly about the radially extending segment.

11. An inflatable and deflatable airbed comprising:

an airtight membrane having an interior and an exterior, the membrane being inflatable by adding air to the interior of the membrane;

a valve integral with the membrane and controlling passage of air into and out of said membrane, said valve having a longitudinal axis and including a housing, said housing defining an air passageway into the interior of the membrane, said air passageway having a greater radius interior of the membrane than exterior of the membrane, said air passageway containing an airflow control assembly, said airflow control assembly including a longitudinally movable plug sized to fit in and move in said air passageway, said housing having an interior end that is spanned by a housing base, said housing base having at least one aperture open to air flow between the air passageway and the interior;

said airflow control assembly biasing said plug toward the exterior of the membrane;

said plug when the plug is forced against the housing in response to said bias, forming an airtight closure to prevent airflow through said air passageway; and said plug when moved in a direction opposite to said bias, opening said valve to air flow through said air passageway, wherein the plug has a body made of a relatively flexible material and a plug seat of a relatively rigid material, said plug seat carrying the plug body.

12. The airbed as set forth in claim 11 wherein the plug seat is disposed interiorly of the plug body.

13. An airflow control valve adapted for use with an airbed comprising:

a valve housing having first and second ports for the passage of air through said valve;

said valve housing enclosing an air passageway between said ports, said air passageway containing an airflow control assembly, said airflow control assembly including a plug movable within said air passageway and fitting into said first port, and a post extending from said plug into the air passageway;

said air passageway having at least first and second portions, said first portion being closer to said first port and of lesser radius than said second portion;

said plug having at least one part thereof with a radius intermediate the radii of said first and second portions;

said housing including a fixed housing base spanning the width of said air passageway second portion, said housing base providing at least one aperture for the open movement of air therethrough, said housing base having a post guide extending into said air passageway in a second direction towards said first port, said post guide slidably receiving said post;

said housing base having a biasing device which biases said plug into contact with said first portion so that said plug closes said air passageway to airflow; and said plug being movable in response to a force greater than said biasing to open the valve to movement of air through said passageway and into the airbed.

14. The airflow control valve according to claim 13 wherein said plug has an outermost flange extending circumferentially around one end of the plug.

15. An airflow control valve adapted for use with an airbed comprising:

An airflow control valve adapted for use with an airbed comprising:

a valve housing having first and second ports for the passage of air through said valve;

said valve housing enclosing an air passageway between said ports, said air passageway containing an airflow control assembly, said airflow control assembly including a plug movable within said air passageway and fitting into said first port, and a post extending from said plug into the air passageway;

said air passageway having at least first and second portions, said first portion being closer to said first port and of lesser radius than said second portion;

said plug having at least one part thereof with a radius intermediate the radii of said first and second portions;

said housing including a fixed housing base spanning the width of said air passageway second portion, said housing base providing at least one aperture for the open movement of air therethrough, said housing base having a post guide extending into said air passageway in a second direction towards said first port, said post guide slidably receiving said post;

said housing base having a biasing device which biases said plug into contact with said first portion so that said plug closes said air passageway to airflow; and said plug being movable in response to a force greater than said biasing to open the valve to movement of air through said passageway and into the airbed said housing includes a flat shell for receiving the plug flange for at least partially sealing the passageway.

16. The airflow control valve as set forth in claim 15 wherein the shelf is defined by a rib extending interiorly from the housing.

17. An airflow control valve adapted for use with an airbed comprising:

An airflow control valve adapted for use with an airbed comprising:

a valve housing having first and second ports for the passage of air through said valve;

said valve housing enclosing an air passageway between said ports, said air passageway containing an airflow control assembly, said airflow control assembly including a plug movable within said air passageway and fitting into said first port, and a post extending from said plug into the air passageway;

said air passageway having at least first and second portions, said first portion being closer to said first port and of lesser radius than said second portion;

said plug having at least one part thereof with a radius intermediate the radii of said first and second portions;

said housing including a fixed housing base spanning the width of said air passageway second portion, said housing base providing at least one aperture for the open movement of air therethrough, said housing base having a post guide extending into said air passageway in a second direction towards said first port, said post guide slidably receiving said post;

said housing base having a biasing device which biases said plug into contact with said first portion so that said plug closes said air passageway to airflow; and said plug being movable in response to a force greater than said biasing to open the valve to movement of air through said passageway and into the airbed wherein the plug has a body made of a relatively flexible material and a plug seat of a relatively rigid material, said plug seat carrying the plug body.

18. The airflow control valve as set forth in claim 17 wherein the plug seat is disposed interiorly of the plug body.

19. An airflow control valve adapted for use with an airbed comprising:

a valve housing having a closable port for the control of air passage between an interior and an exterior of an inflatable volume, said valve housing enclosing an air passageway, said air passageway containing an airflow control assembly;

said airflow control assembly including a movable plug having a plug seat which normally forms an airtight seal with said port, and a post guide extending from said plug seat into the air passageway;

a fixed housing base spanning a side of said housing, said housing base being open to air movement therethrough and having a post extending into said air passageway, said post sliding within said post guide;

a biasing device biasing the plug with a biasing force away from said housing base towards said port so that said plug normally forms an airtight seal with said port to close the air passageway to airflow; and said plug being movable in response to a force greater than said biasing to open the valve to movement of air through said passageway.

20. A method of connecting an air pump with an airflow control valve adapted for use with an airbed comprising the steps of:

providing a valve having a closable port for the control of air passage between an interior and an exterior of an inflatable volume;

said valve including a housing enclosing an air passageway and having an outward extension, said outward extension incorporating a connector, said air passageway containing an airflow control assembly;

said airflow control assembly including a movable plug which normally forms an airtight seal with said port, and a post extending from said plug seat into the air passageway;

a fixed housing base spanning an inward side of said housing, said housing base open to air movement therethrough and having a post guide extending into said air passageway, said post guide slidably receiving said post;

a biasing device biasing the plug away from said housing base towards said port so that the plug forms the airtight seal with said port to close the air passageway to airflow;

providing an adaptor configured to make a releasable connection with said housing extension connector, the adaptor having a connected position which opens said air passageway to airflow, said adaptor encompassing an auxiliary air passageway;

introducing said adaptor inward into said port with a force greater than said biasing to open said air passageway to airflow and making said releasable connection to hold said adaptor in said connected position without continuing application of said force.

21. The method according to claim 20 wherein said adaptor auxiliary air passage is configured to provide an air passageway between an air pump and said valve.

22. The method according to claim 20 wherein said adaptor is integrated into an air pump.

* * * * *